United States Patent [19]

Adler

[11] Patent Number: 5,039,907

[45] Date of Patent: Aug. 13, 1991

[54] SPARKLE-FREE COLOR DISPLAY

[75] Inventor: Robert Adler, Northfield, Ill.

[73] Assignee: Zenith Electronics Corporation, Glenview, Ill.

[21] Appl. No.: 298,540

[22] Filed: Jan. 17, 1989

[51] Int. Cl.[5] ..... H01J 29/89

[52] U.S. Cl. ..... 313/478; 341/34; 358/252

[58] Field of Search ..... 313/478, 474; 341/31, 341/33, 34; 358/252, 251

[56] References Cited

U.S. PATENT DOCUMENTS

| | | | |
|---|---|---|---|
| 2,746,030 | 5/1956 | Schrecongost | 358/251 |
| 3,114,668 | 12/1963 | Guiles | 313/478 X |
| 3,652,895 | 3/1972 | Tsuneta et al. | 313/403 |
| 3,851,093 | 11/1974 | Sunstein | 358/251 X |
| 4,542,375 | 9/1985 | Alles et al. | 341/31 X |
| 4,644,100 | 2/1987 | Brenner et al. . | |
| 4,700,176 | 10/1987 | Adler | 341/34 X |
| 4,746,914 | 5/1988 | Adler . | |
| 4,766,424 | 8/1988 | Adler et al. | 341/31 X |
| 4,791,416 | 12/1988 | Adler | 341/34 X |
| 4,794,299 | 12/1988 | Chiodi et al. | 313/408 X |

FOREIGN PATENT DOCUMENTS

| | | | |
|---|---|---|---|
| 105142 | 6/1985 | Japan | 313/474 |

*Primary Examiner*—Palmer C. DeMeo

[57] ABSTRACT

A color display is disclosed that has on an inner display surface a periodic pattern of luminescent deposits having a smallest deposit-to-adjacent-deposit pitch "P-D". The display has on an outer surface glare reduction means in the form of an undulating periodic pattern of light-scattering elements whose smallest element-to-adjacent-element pitch "P-E" is significantly less than the pitch "P-D" to avoid moiré effects, but significantly greater than the longest wavelength of visible light to minimize diffraction effects. The color display according to the invention may comprise a color cathode ray tube havbing a touch panel on its front surface.

29 Claims, 3 Drawing Sheets

FIG. 4

SPARKLE-FREE COLOR DISPLAY

BACKGROUND OF THE INVENTION

This invention relates to color cathode ray tubes or other color video displays having front surface anti-glare treatments.

It is known to use an interference type anti-reflective coating on the face of a cathode ray tube in applications where the cost of such coatings can be tolerated and where finger contact is not contemplated.

It is also known to randomly roughen or perturb the front surface of a cathode ray tube, or to overlay a transparent membrane or panel, such that it scatters reflected light. This random roughening has been accomplished by vapor or submerged etching, mold roughening, surface grinding, sprays and in various other ways.

However, roughening the front surface of a CRT or an overlay thereon, degrades the underlying cathodeluminescing image by dispersing the image light emitted from the phosphor screen. The roughened surface approach is practical, however, in many applications because the angular dispersion of emitted image light is substantially less than the angular scattering of reflected light.

The surface roughening approach is a satisfactory solution to the front surface glare problem for most applications of monochrome and color cathode ray tubes, however, attempts to apply the same surface roughening techniques to certain shadow mask color cathode ray tubes has been found to produce a conspicuous visual phenomenon which has been described as a "sparkle". The sparkle phenomenon appears to be less conspicuous in line screen color CRTs than in dot screen type CRTs (those with shadow masks having circular holes). One application in which the sparkle phenomenon can be disturbing is a high resolution shadow mask color CRT of the flat tension mask type overlaid with a plastic membrane, such as is used in certain touch-responsive systems. The membrane is of a type having a particulate anti-scratch/anti-glare surface coating.

This sparkle is believed to result from random moire' effects. The visual impression of this random moire' or sparkle is one of little pinpoints of light or sparkles (and occasionally dark spots) which come and go. They appear to move as the observer's head is moved, sometimes in the same direction as the head movement and sometimes in the opposite direction.

PRIOR ART

U.S. Pat. Nos. 4,644,100; 4,700,176; 4,764,914; 4,766,424; 4,791,416, and 4,794,299.

OBJECTS OF THE INVENTION

It is an object of this invention to provide means for overcoming the aforedescribed sparkle or random moire' effect which occurs in color cathode ray tubes having surface-roughened type anti-reflective treatments.

It is another object to provide means for overcoming the aforesaid sparkle phenomenon as it occurs in color cathode ray tubes or other color displays with touch-responsive membranes, or other overlays having a random light-scattering treatment on the front surface thereof.

It is yet another object to provide such means which is relatively inexpensive while having favorable anti-reflection properties.

It is still another object to provide means for overcoming the aforesaid sparkle effect which is highly efficient in scattering reflected light, yet does not seriously impair the underlying emitted light image.

It is yet another object to provide means that overcome the sparkle effect without creating undesired effects such as diffraction or moire', or other artifacts which may impair the viewed image.

It is still another object to provide means which overcome the aforesaid sparkle effect uniformly across all parts of a screen, even in displays in which the underlying phosphor screen pattern varies in pitch across the screen.

It is a further object of the invention to provide anti-sparkle means for touch-responsive screens which is immune to fingerprinting.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

FIGS. 1–4 depict a preferred embodiment of the invention as applied to a color display of the flat tension mask color cathode ray tube type having a membrane touch-responsive overlay.

As discussed above, the problem to which this invention is addressed is a conspicuous "sparkle" effect which has been witnessed in color cathode ray tubes having front surface anti-glare treatments of the type which present random light-scattering centers to reflected light. The pinpoints of light which are described as a "sparkle" can appear in front of or behind the screen and appear to move with head movement. The sparkle effect seems to be limited to high resolution and medium resolution displays but is more pronounced in the high resolution variety. It has been observed in both standard curved face CRTs and flat-faced CRTs. It is occasionally perceived in color cathode ray tubes of the slot mask type, but is more pronounced in tubes of the dot mask variety.

Figure 1:
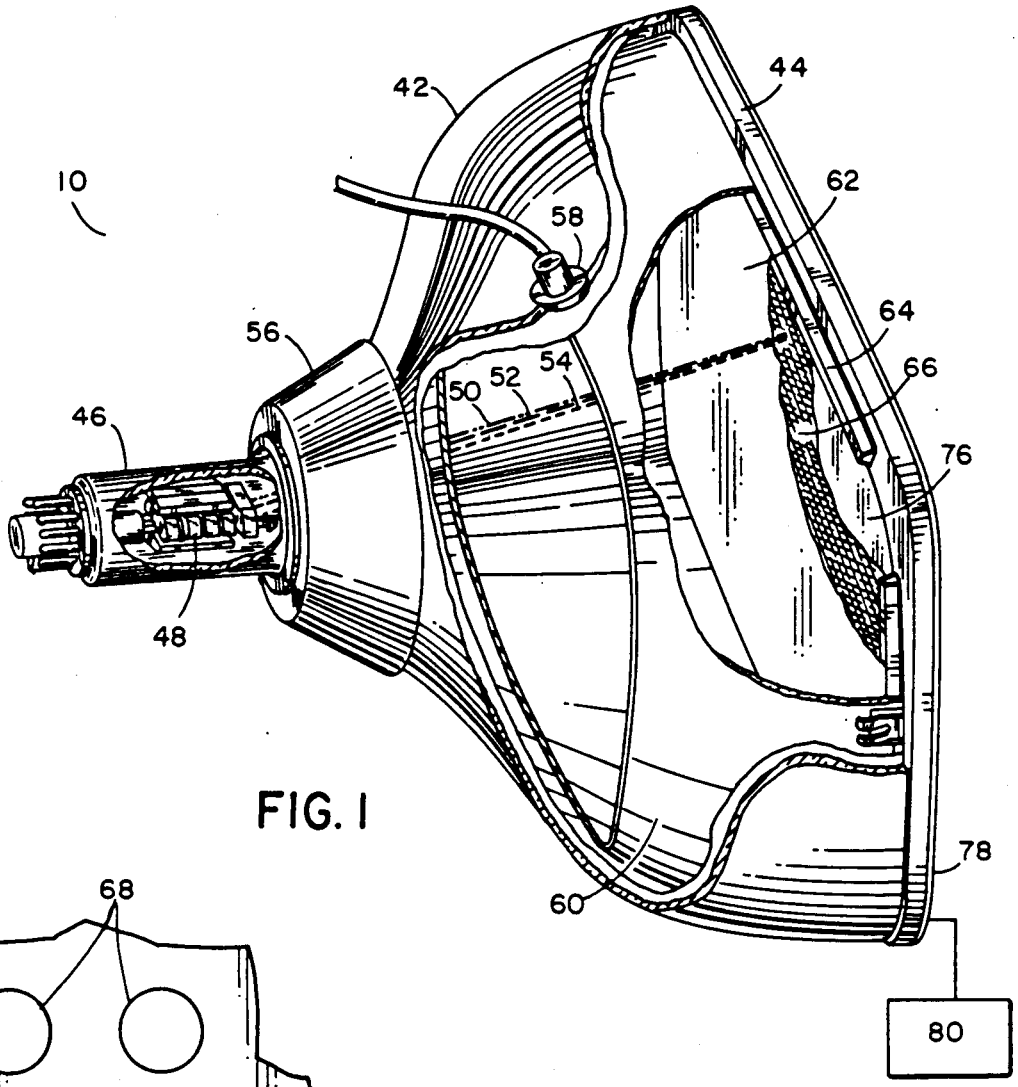
FIG. 1 is a schematic perspective view of a color cathode ray tube of a type with which this invention is concerned with a membrane-type touch response system; the tube envelope is partially cut away to show location and relationship of major components.

One application in which a disturbing sparkle is seen is a high resolution color cathode ray tube 10 of the flat tension mask type depicted in FIG. 1. This tube has a touch-responsive membrane with an anti-glare/anti-scratch particulate coating. The tube is modified in accordance with the present invention to overcome the aforedescribed sparkle problem.

Tube 10 is indicated as comprising a funnel 42 joined with a flat faceplate 44. Within the neck 46 of the tube is a three-beam in-line type electron gun 48 which produces red-associated, blue-associated and green-associated electron beams 50, 52, and 54 respectively, which are swept across the screen by electrically energizing a yoke 56.

High voltage is applied to the screen and conductive inner coating through an anode button 58. An internal magnetic shield 60 shields the three beams from the earth's magnetic field and other stray magnetic fields.

Figure 1A:
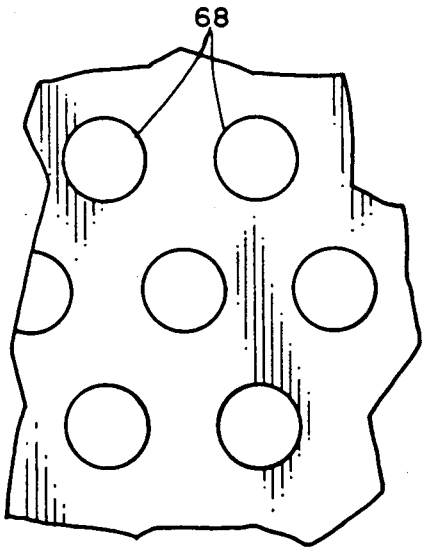
FIG. 1A is a detail view of the apertures of the shadow mask depicted in FIG. 1.
Figure 1B:
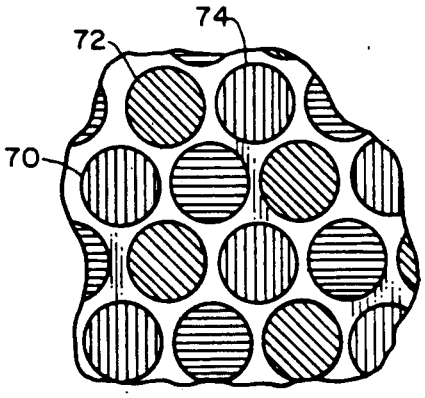
FIG. 1*b* is a detail view of the pattern of phosphor deposits comprising the screen of the tube.

A flat tension mask 62 is supported on support rails 64 in spaced adjacency to a phosphor screen 66. The shadow mask 62 is of the "dot mask" type, that is, one having circular holes 68; the aperture pattern is indicated in detail in FIG. 1A. The screen is of the dot type comprising a hexagonal array of closely packed circular red-emissive, blue-emissive and green-emissive phosphors 70, 72 and, 74 respectively; the phosphor pattern is indicated in detail in FIG. 1B. An aluminum film 76 is used for high voltage energization of the screen and to reflect phosphor-emitted light forwardly to the viewer.

A membrane 78 comprising part of a touch responsive system is electrically connected to an electronic touch control 80 which monitors and determines the position of a finger touch on the membrane 78.

Figure 2:
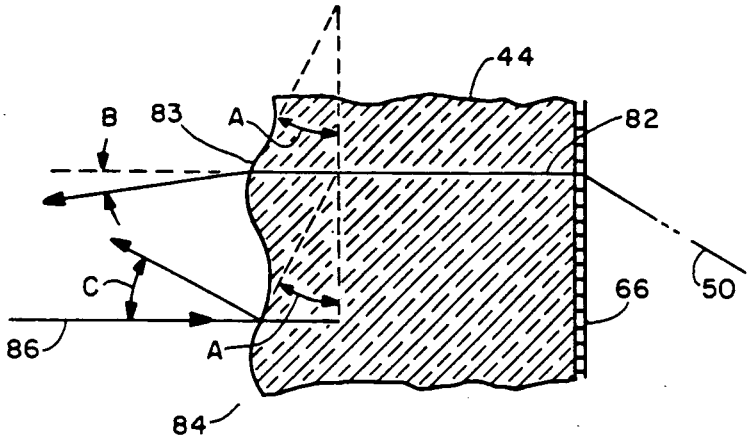
FIG. 2 is a schematic sectional view in perspective of a fragment of the faceplate shown in FIG. 1, illustrating the effect of the invention on emitted image light and reflected ambient light; a cutaway section indicates a pattern of phosphor deposits on the screen area.
Figure 3:
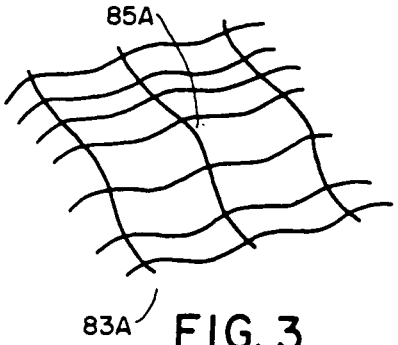
FIG. 3 is a close-up view of a two-dimensional, anti-glare pattern in accordance with this invention.
Figure 4:
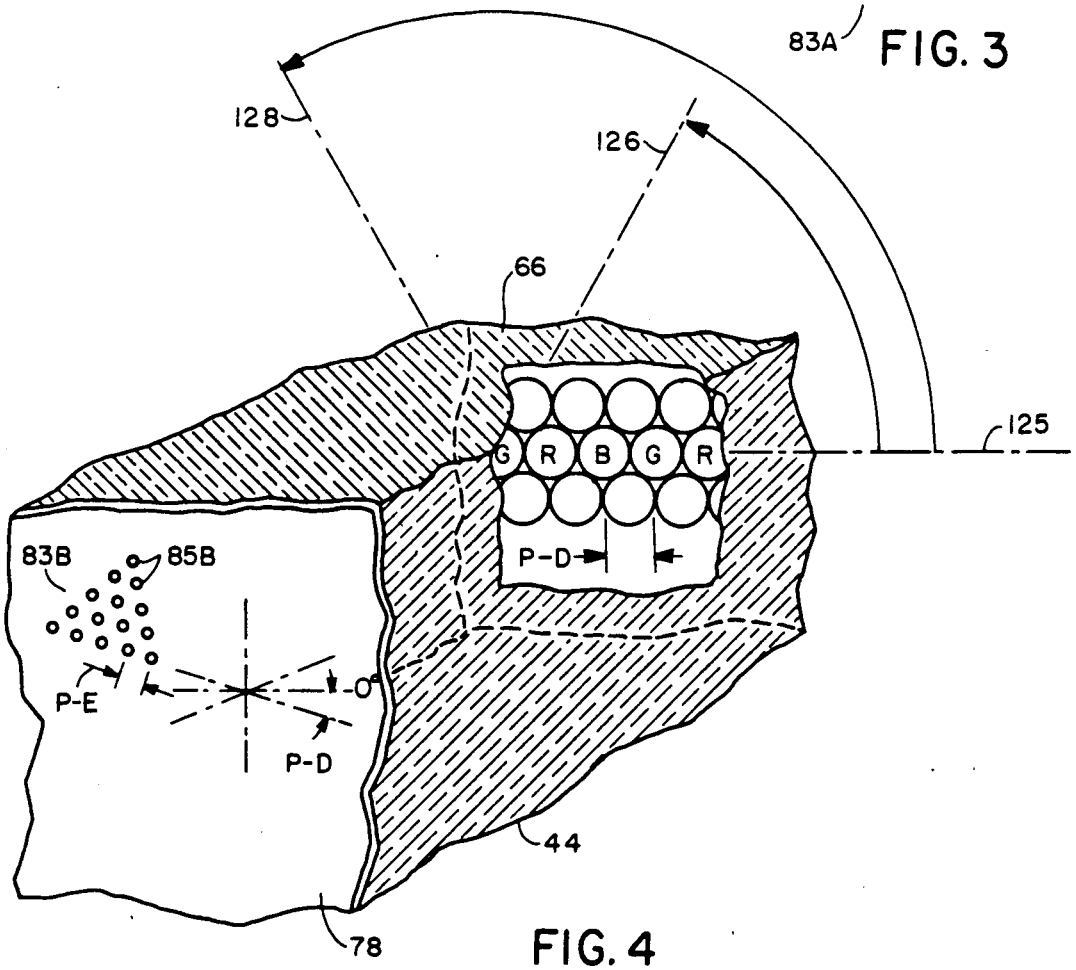
FIG. 4 is an enlarged schematic fragmentary view in perspective of a section of the faceplate of FIG. 1; a touch membrane on the front of the faceplate is shown, and a cutaway section indicates the pattern of phosphor deposits on the screen area opposite.

FIGS. 2–4 depict glare-reduction means in accordance with the present invention as indicated on the front face of membrane 78. It has been conventional wisdom to use a random light scattering coating or treatment on the face of a color display in order to assure no moire' interaction between the light-scattering anti-glare treatment and the underlying patterned phosphor screen. However, it is my belief that, contrary to this conventional wisdom, it is the very random nature of such light scattering anti-glare treatments which is the cause of the described sparkle phenomenon, as will be described in more detail hereinafter. This invention radically departs from the prior approach of randomizing the light scattering surface by substituting a regular pattern 83 of light-scattering elements 84. I have found that, by appropriately configuring the periodic light-scattering pattern 83, moire' effects are suppressed without loss of the beneficial attributes of the use of a front surface light-scattering treatment. The objectionable sparkle is thus eliminated by this invention without introducing moire' or other deleterious artifacts.

Before engaging in a detailed description of the present invention, it will be helpful to understand why an anti-glare treatment of the light-scattering type is beneficial. It is understood, of course, that the introduction of light-scattering centers on the front surface of a display, spaced from the cathodoluminescent image surface, will necessarily cause some degradation of the image formed in the cathodoluminescent layer because of the dispersion of the image light as it passes through the light-scattering surface.

FIG. 2 indicates why anti-glare treatments of the light-scattering type are nevertheless beneficial in many applications. A light ray 82 emitted from the phosphor screen 66 passes through the surface of a light-scattering element 84 at an angle "A" relative to the screen 66. From Snell's law for small angles, the ray 82 will be deflected by an angle "$B$"$=A(n-1)$ from its original course as it emerges from the display into the ambient environment, where "n" is the refractive index of element 84. For many types of glass and for most plastics, n is close to 1.5, so B is approximately 0.5A.

However, a light ray 86 arriving from outside the tube is reflected off the surface of light-scattering element 84 (assumed to be at the same angle "A" relative to the screen 66) through an angle "C" relative to the angle of incidence. Angle "C", according to the law of specular reflection, is equal to 2A and is, therefore, approximately four times angle "B", which is to say that reflected light is scattered to a much greater degree than image light is dispersed. Thus there is a beneficial trade-off of a small amount of image acuity for a large amount of glare reduction.

A color display according to the invention has on an inner display surface a periodic pattern of luminescent deposits having a smallest deposit-to-adjacent-deposit pitch "P-D". On an outer surface there are glare-reduction means in the form of an undulating periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects. Each element comprises a gentle undulation having an amplitude great enough to scatter reflected light and suppress specular reflections, but small enough to prevent unacceptable degradation of images formed by the luminescent deposits. The gentle undulations are substantially sinusoidal, and preferably, the pattern of light-scattering elements is azimuthally rotated relative to the pattern of luminescent deposits such that the element axes are intermediate the deposit axes to minimize moire' interaction between the patterns.

In accordance with the preferred execution of this invention, a periodic pattern 83A or 83B of light-scattering elements 85A or 85B satisfies a number of requirements. First, the pattern should preferably be two dimensional, although a one-dimensional, wash-board-like light-scattering pattern may be employed. FIG. 3 shows a two-dimensional pattern 83A. The reflection of a point source of light is drawn apart into a narrow line by a one-dimensional pattern; light is more effectively scattered and glare-reduced by a two-dimensional pattern which distributes the light reflected from a point source over an area rather than a line.

While the light-scattering pattern 83A of FIG. 3 consists of two undulations intersecting at right angles, thus creating light-scattering elements or convexities 85A, a pattern based on three undulations forming a hexagonal arrangement 83B of convexities 85B separated by valleys, is shown in FIG. 4. This figure also illustrates an essential relationship concerning spatial frequencies.

The spatial frequency of the pattern is critically important in order to prevent moire' interactions with the underlying phosphor pattern. Specifically, the periodic light-scattering pattern will have a smallest element-to-adjacent-element pitch of the input-scattering patterns ("P-E" in FIG. 4) which is significantly less than the smallest phosphor-deposit-to-adjacent-deposit pitch ("P-D" in FIG. 4). "P-E" should be sufficiently smaller than "P-D" so that no beat frequencies between the patterns are visible at normal viewing distances. Further, the pitch "P-E" should be chosen relative to pitch "P-D" such that "P-E" is not harmonically related to "P-D", again to avoid visible beats.

Figure 5A:
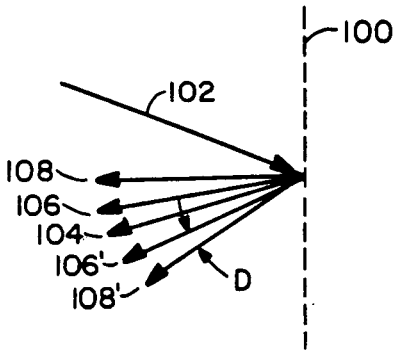
FIGS. 5A and 5B, respectively, show schematically the effect on collimated light when reflected from, and when passing through, a phase grating.
Figure 5B:
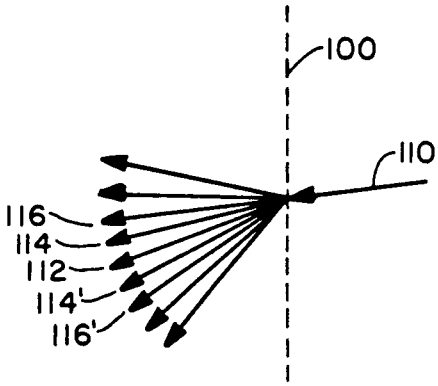

However, at the other extreme, diffraction effects must be minimized. Any transparent sheet or plate carrying a spatially periodic pattern on its surface constitutes a diffraction grating which has the inherent property of splitting incident light, in reflection as well as in transmission, into a number of orders going off in different directions. In FIG. 5A, collimated light is depicted as arriving at grating 100 along a direction 102, and is reflected along direction 104 which is the direction expected from a plane mirror; but light is also reflected along directions 106 and 106' (first order diffraction), 108 and 108' (second order diffraction), and so forth. In FIG. 5B, collimated light 110 is shown as arriving from the opposite side. Some of the light, indicated by reference number 112, continues as if it had been refracted by a plane surface; but light also emerges along directions 114 and 114' (first order), 116 and 116' (second order), and so on.

In the small angle approximation, the angle D between adjacent orders in transmission as well as in reflection equals the light wavelength divided by the grating pitch; for example for a wavelength of 0.56 micrometer (yellowish-green light) and a grating pitch of 56 micrometer, or about 0.0022", angle D is 0.01 radians, or 0.57 degree.

In the case of interest here, the spatial periodic pattern is formed by a corrugated transparent surface which does not obstruct light anywhere, but provides a periodically varying optical path length. This is called a phase grating. As was explained before diffraction was considered, such a grating scatters light over a wider angle in reflection than in transmission; but when diffraction is taken into account, it becomes evident that certain precautions must be taken. This is best illustrated with the aid of a numerical example.

Consider a surface carrying a shallow sinusoidal ripple in one dimension only, so that incident collimated light will be scattered along that dimension. Suppose the maximum angle of the sinusoid with respect to the average plane is plus and minus 1.5 degrees, providing scattering of reflected light over a range of plus and minus 3 degrees, and (assuming a refractive index of $n=1.5$), scattering off transmitted light by plus and minus 0.75 degree. These figures do not take diffraction into account. Two versions of this device, maintaining the same maximum angle and differing only in pitch, will now be compared. Without considering diffraction, they would work equally well.

First assume that the pitch is 100 micrometers or about 0.004". The angle between diffraction orders for yellowish-green light is 0.32 degrees. This is a small fraction of the scattering angle even for transmitted light; it means that the transmitted light, rather than being uniformly distributed across the previously mentioned plus and minus 0.75 degree, is split up into five closely-spaced-modes—the zero order, a pair of first order modes and a pair of second order modes. Higher order modes, falling outside the 0.75 degree boundary, carry very little light and are not considered here.

Similar reasoning applies to reflection, except that here many more modes exist.

When such a corrugated surface is used as an overlay on a flat tension mask color cathode ray tube, angular scattering of transmitted light at the surface is observed as broadening of screen detail. For the typical thickness of faceplate glass plus plastic overlay, plus and minus 0.75 degree corresponds to an image spread of plus and minus 0.0057", a permissible impairment of resolution. The individual diffraction orders appear separated by only 0.0024", which is not perceptible.

Take, however, a similar grating with a pitch of only 25 micrometers or about 0.001". The angle D between adjacent diffraction orders is now 1.28 degrees. Since this is larger than the scattering angle of plus and minus 0.75 degree for transmitted light, most of the light remains in the zero order mode, which is desirable; however, the two first order modes, while weaker, are strong enough to be visible, and on the flat tension mask tube they appear to be separated from the zero order by plus and minus 0.010", enough to be resolved at normal viewing distance. The resulting triple image is highly disturbing and unacceptable.

In addition, reflected light from the corrugated surface is now split up into about five distinct orders, an effect nearly as disturbing as a single specular reflection. It follows that a pitch smaller than about 0.002" (50 micrometers), corresponding to about 90 wavelengths of yellowish-green light, should not be used.

Figure 5C:
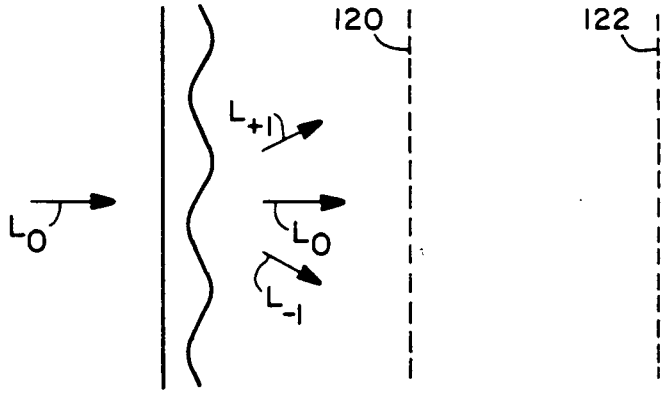
FIG. 5C shows schematically the effect of a phase grating illuminated by spatially coherent light.

There is an additional factor which should be considered in choosing the grating pitch. It was mentioned previously that the corrugated periodic surface constitutes a phase grating. When a phase grating is illuminated by a beam of collimated, spatially coherent light, the phenomena illustrated in FIG. 5C are observed. Specifically, FIG. 5C applies to the case of a sinusoidal grating which generates in transmission only the plus and minus first diffraction orders. The undiffracted light $L_0$ and the two diffracted orders $L_{+1}$ and $L_{-1}$ gradually change their mutual phase relationship as the light travels away from the grating, with the result that a screen 120 inserted at a distance $d=p^2/2\lambda$ (p=pitch of grating, $\lambda$=wavelength in the medium which fills the space between grating and screen) would show a sinusoidal pattern of light and dark stripes, i.e. an amplitude grating. At a distance $2d=p^2/\lambda$, the effect disappears again, i.e., a screen inserted 122 at that distance would show uniform illumination and no stripes would be visible.

It has been found that is a periodic pattern of light and dark stripes, simulating the pattern of phosphor dots on the screen of a color tube, is viewed through a phase grating such as the one useful in carrying out this invention, similar effects are observed. No moire' pattern, or only a very weak pattern, is visible when the phase grating is laid directly upon the stripe pattern. As the spacing between the two patterns is increased, visibility of the moire' pattern goes through a maximum and then back to a minimum. Because phase gratings useful in carrying out this invention produce more than a single pair of orders, the minimum is not as sharp as in the illustration of FIG. 5C, but it is easily observable.

This is true even though the different colors produced by a color cathode ray tube form their minima at different distances.

As a numerical example, in a practical case the combined thickness of faceplate, plastic bonding layer, safety glass and plastic overlay may be 0.67"=17 mm. For yellowish-green light, generally considered the predominant color, with a wavelength in air of 0.56 micrometer, and with an average refractive index of 1.5, the predominant effective wavelength within the glass and plastic will be 0.373 micrometer, and the pitch required to achieve the theoretical minimum of moire' visibility is 80 micrometer, or 3.14 mils. As previously explained, this is not sharp optimum, and the exact pitch should be selected on the basis of overall performance. It is advisable, however, not to depart too much from the theoretical minimum visibility condition, and in any case to avoid choosing a pitch corresponding to the maximum visibility condition.

Thus, in short, the spatial frequency of the light-scattering pattern must be selected sufficiently greater than that of the underlying phosphor pattern that difference frequency beats are not visible, and such that harmonic beats are avoided. Yet the smallest period of the light-scattering pattern must be sufficiently greater than the longest wavelength of visible light to minimize the aforesaid diffraction effects. And finally, consideration must be given to the visibility maximum and minimum for the given distance between pattern 83A or 83B and the phosphor screen.

Yet another requirement realized in a preferred execution of the present invention is that the undulations in the surface, the "tilt angle" of the light altering surface, be as low in amplitude as possible (in order to minimize image light dispersion), yet great enough to achieve the minimum necessary scattering of ambient light. Further, in order to minimize diffraction-induced dispersion of image light, it is desirable to come as close to a sine wave profile in the light altering surface as is possible. For example, in a preferred execution, the light-altering surface of the light-scattering pattern would have maximum tilt angles of about 1.5 degrees and would be purely sinusoidal.

In accordance with this invention, the light-scattering pattern 83A or 83B is preferably rotated relative to the underlying phosphor screen pattern. As illustrated in FIG. 4, the light-scattering pattern 83B is shown rotated relative to the three major axes of the phosphor pattern, as explained in the following.

It has been found that the pitch P-E of the light-scattering pattern 83B is less critical if that pattern is rotated azimuthally relative to the underlying pattern of phosphor deposits, such that the element axes are intermediate the deposit axes and are positioned to minimize moire' effects. In the illustrated embodiment, the phosphor deposits form an equilateral hexagonal pattern which has two pronounced spatial frequencies (see FIG. 4), one along the horizontal axis 125 (i.e. at 0 degrees), at 60 degrees (126) and 120 degrees (128) to that axis, the other at 30, 90 and 150 degrees from the horizontal (not indicated). In the preferred embodiment, a hexagonal light-scattering pattern 83B is rotated about 15 degrees relative to the underlying phosphor pattern. Light-scattering pattern 83B consists of three sets of gently undulating sinusoidal ripples which intersect at 60 degree angles, thus forming a surface having a hexagonal pattern of convexities 85B separated by intersecting valleys.

A light-scattering pattern consisting of only two undulations intersecting at right angles may be used in place of the hexagonal pattern, and again its pitch is found to be less critical if its two axes are rotated by a small angle with respect to the 0 and 90 degree axes of the phosphor pattern.

In a flat tension mask color cathode ray tube of the type illustrated, it is known to vary the pitch of the phosphors across the screen in order to reduce or eliminate beam "degrouping." (See U.S. Pat. No. 4,794,299, for example.)

The glass faceplate of a shadow mask color cathode ray tube display has on an inner display surface a periodic pattern of luminescent deposits whose smallest deposit-to-adjacent-deposit pitch "P-D" is different in different parts of the display. A touch-responsive membrane on the faceplate has on an outer surface glare-reduction means comprising a periodic pattern of light-scattering elements whose smallest element-to-adjacent-element pitch "P-E" is significantly greater than the longest wavelength of visible light to minimize diffraction effects. The pitch "P-E" varies across the display according to the invention to preserve a predetermined geometrical relationship between the patterns in at least predetermined different parts of the display when the membrane is overlaid on the display. This arrangement according to this aspect of the invention is effective to eliminate sparkle and moire' in all parts of the screen.

Figure 6A:
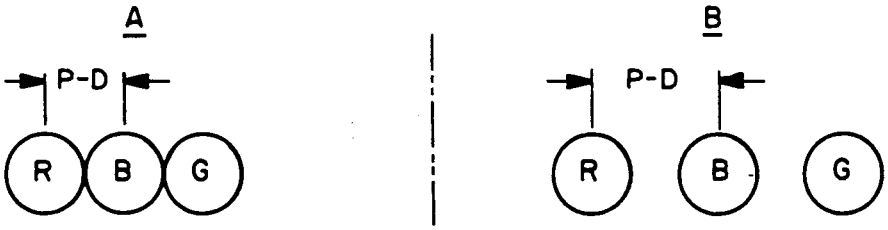
FIGS. 6A and 6B illustrate schematically the variance of pitch of light-scattering elements in correlation with the variance of pitch in corresponding phosphor deposits.
Figure 6B:
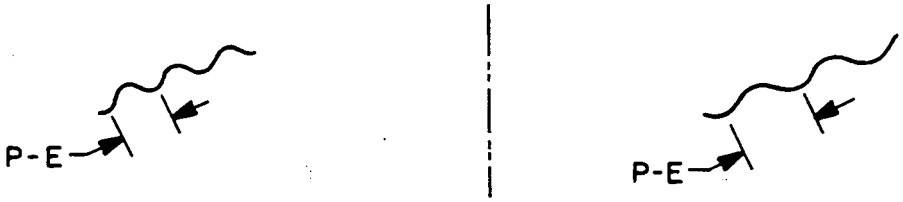

FIG. 6A shows schematically a phosphor screen wherein the phosphor deposit pitch P-D increases from the center of the screen (zone "A") to the edge of the screen (zone "B"). As shown in FIG. 6B, a corresponding increase in the pitch P-E of the light-scattering elements may be employed. The present invention may be reduced to practice in an application of the type described by embossing the surface of a plastic sheet with a heated roller, or by compression or injection molding.

A preferred embodiment of this invention operates in connection with a high-resolution color tube in which the smallest phosphor deposit pitch P-D is 0.00534 inch in the central region of the tube, the corresponding directions being 30, 90 and 150 degrees from the horizontal. The smallest pitch "P-E" of the light-scattering pattern is 0.0035 inch along two orthogonal directions. The orientation of the light-scattering pattern is not critical, however a useful range is centered at 15 degrees from the horizontal. Along each of the two orthogonal directions of the pattern, the surface profile is a sinusoid with a peak-to-peak amplitude of 0.75 micrometers, and with a maximum slope of plus and minus 1.5 degrees.

This invention has been described in connection with a dot-type screen and dot mask; however, this invention is just as applicable to tubes using the slot mask and phosphor stripes, as opposed to phosphor dots. The choice of spacing between light-scattering elements is not as critical with a line screen as it is with a dot screen. In any case, the pattern of light-scattering elements according to the invention would still be two-dimensional; e.g., as shown in FIG. 3.

Generally, with dot screen as well as line screens, the optimum spatial frequencies along two orthogonal axes, e.g., the horizontal and vertical directions, will not be the same, and it is within the scope of this invention to use different spacings between light-scattering elements along two orthogonal axes.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

I claim:

1. A sparkle-free, anti-glare high resolution display including a transparent faceplate having on an inner display surface a periodic pattern of luminescent deposits having a smallest deposit-to-adjacent-deposit pitch "P-D" and having on an outer surface glare reduction means in the form of an undulating periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, the element pitch "P-E" being in the order of about 3 mils.

2. A sparkle-free, anti-glare high resolution color display including a transparent faceplate having on an inner display surface a periodic pattern of luminescent deposits, and having on an inner surface glare reduction means in the form of an undulating regular pattern of light-scattering elements, each element comprising a gentle undulation having an amplitude great enough to scatter reflected light and suppress specular reflections, but small enough to prevent unacceptable degradation of images formed by said luminescent deposits, said undulating pattern being periodic in two dimensions, the maximum tilt angle of elements being in the order of about 1.5 degrees.

3. The display defined by claim 2 wherein said undulations are substantially sinusoidal.

4. A sparkle-free, anti-glare high resolution color display including a transparent faceplate having on an inner display surface a periodic pattern of luminescent deposits with deposits oriented along two or more deposit axes, and having on an outer surface a periodic pattern of light-scattering elements oriented along two or more element axes, said pattern of light-scattering elements being azimuthally rotated relative to said pattern of luminescent deposits such that said element axes are intermediate said deposit axes to minimize moire' interaction between said patterns, the element pitch of said light-scattering elements being approximately equal to the square root of the product of the distance between said inner and outer surfaces and the wavelength of the predominate light within the faceplate material.

5. The display defined by claim 4 wherein the individual elements in said pattern of light-scattering elements are substantially sinusoidal.

6. A sparkle-free, anti-glare high resolution color display including a transparent faceplate having on an inner display surface a periodic pattern of luminescent deposits whose smallest element-to-adjacent-element pitch "P-D" is different in predetermined different parts of the display, and having on an outer surface glare reduction means in the form of an undulating periodic pattern of light-scattering elements whose smallest element-to-adjacent-element pitch "P-E" also varies across the display to establish a predetermined geometrical relationship between said patterns in at least said predetermined different parts of the display.

7. A sparkle-free, anti-glare high resolution color display including a transparent faceplate having on an inner display surface a periodic pattern of luminescent deposits having a smallest deposit-to-adjacent-deposit pitch "P-D" and having on an outer surface glare reduction means in the form of an undulating periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, said pitch "P-E" being approximately equal to the square root of the product of the distance between said inner and outer surfaces and the wavelength of the predominant light within the faceplate material.

8. A sparkle-free, anti-glare high resolution color display including a transparent faceplate having on an inner display surface a two-dimensionally periodic pattern of luminescent deposits having a smallest deposit-to-adjacent-deposit pitch "P-D", and having an outer surface glare reduction means comprising a two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, said pattern of light-scattering element being azimuthally rotated relative to said deposit pattern to minimize moire' interaction between said patterns, each element comprising a gentle undulation having an amplitude great enough to scatter reflected light and suppress specular reflections, but small enough to prevent unacceptable degradation of images formed by said luminescent elements when stimulated, the element pitch "P-E" being in the order of about 3 mils, and the maximum tilt angle of elements being in the order of about 1.5 degrees.

9. A sparkle-free, anti-glare high resolution color display including a transparent faceplate having on an inner display surface a periodic pattern of luminescent deposits whose smallest deposit-to-adjacent-deposit pitch "P-D" is different in different parts of the display, and having on an outer surface glare reduction means comprising a periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, the pitch "P-E" varying across the display to preserve a predetermined geometrical relationship between said patterns in at least said predetermined different parts of the display.

10. A sparkle-free, anti-glare high resolution color display including a transparent faceplate having on an inner display surface a two-dimensionally periodic pattern of luminescent deposits having a smallest deposit-to-adjacent-deposit pitch "P-D" which is different in different parts of the display, and having on an outer surface glare reduction means comprising a two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, the pitch "P-E" varying across the display to preserve a predetermined relationship between said patterns in at least said predetermined different points of the display, said pattern of light-scattering elements being azimuthally rotated relative to said deposit pattern to minimize moire' interaction between said patterns, each element comprising a gentle undulation having an amplitude great enough to scatter reflected light and suppress specular reflections, but small enough to prevent unacceptable degradation of images formed by said luminescent elements when stimulated.

11. A sparkle-free, anti-glare high resolution shadow mask color CRT display comprising a glass faceplate having on an inner display surface a periodic pattern of luminescent deposits having a smallest deposit-to-adjacent-deposit pitch "P-D", said display having on the front of said CRT a touch responsive membrane which has on an outer surface glare reduction means comprising a periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, the element pitch "P-E" being in the order of about 3 mils.

12. A sparkle-free, anti-glare high resolution shadow mask color CRT display comprising a glass faceplate having on an inner display surface a periodic pattern of luminescent deposits with deposits oriented along two or more deposit axes, said display having on the front of said CRT a touch responsive membrane which has on an outer surface a periodic pattern of light-scattering elements oriented along two or more element axes, said pattern of light-scattering elements being azimuthally rotated relative to said deposit pattern such that said element axes are intermediate said deposit axes to minimize moire' interaction between said patterns, said pitch "P-E" being approximately equal to the square root of the product of the distance between said inner and outer surfaces and the wavelength of the predominant light within the faceplate material.

13. The display defined by claim 12 wherein the individual elements in said pattern of light-scattering elements are substantially sinusoidal.

14. A sparkle-free, anti-glare high resolution shadow mask color CRT display comprising a glass faceplate having on an inner display surface a periodic pattern of luminescent deposits whose smallest element-to-adjacent-element pitch "P-D" is different in predetermined different parts of the display, said display having on the front of said CRT a touch responsive membrane which has on an outer surface glare reduction means comprising a regular pattern of light-scattering elements whose smallest element-to-adjacent-element pitch "P-E" also varies across the display to preserve a predetermined geometrical relationship between said patterns in at least said predetermined different parts of the display.

15. A sparkle-free, anti-glare high resolution shadow mask color CRT display comprising a glass faceplate having on an inner display surface a two-dimensionally periodic pattern of luminescent deposits having a smallest deposit-to-adjacent-deposit pitch "P-D", said display having on the front of said CRT a touch responsive membrane whose outer surface has glare reduction means in the form of an undulating two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, said pattern of light-scattering elements being azimuthally rotated relative to said deposit pattern to minimize moire' interaction between said patterns, the maximum tilt angle of elements being in the order of about 1.5 degrees, and said pitch "P-E" being approximately equal to the square root of the product of the distance between said inner and outer surfaces and the wavelength of the predominant light within the faceplate material.

16. A sparkle-free, anti-glare high resolution shadow mask color CRT display comprising a glass faceplate having on an inner display surface a two-dimensionally periodic pattern of luminescent deposits having a smallest deposit-to-adjacent-deposit pitch "P-D", said display having on the front of said CRT a touch responsive membrane which has impressed in an outer surface glare reduction means comprising a two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, said pattern of light-scattering elements being azimuthally rotated relative to said deposit pattern to minimize moire' interaction between said patterns, each element comprising a gentle undulation having an amplitude great enough to scatter reflected light and suppress specular reflections, but small enough to prevent unacceptable degradation of images formed by said luminescent elements when stimulated, the maximum tilt angle of elements being in the order of about 1.5 degrees.

17. A sparkle-free, anti-glare high resolution shadow mask color CRT display comprising a glass faceplate having on an inner display surface a periodic pattern of luminescent deposits whose smallest deposit-to-adjacent-deposit pitch "P-D" is different in different parts of the display, said display having on the front of said CRT a touch responsive membrane which has impressed in an outer surface glare reduction means comprising a periodic pattern of light-scattering elements whose whose smallest element-to-adjacent-element pitch "P-E" is significantly less than the pitch "P-D" to avoid moire' effects, but significantly greater than the longest wavelength of visible light to minimize diffraction effects, the pitch "P-E" varying across the display to preserve a predetermined geometrical relationship between said patterns in at least said predetermined different parts of the display.

18. A sparkle-free, anti-glare high resolution shadow mask color CRT display comprising a glass faceplate having on an inner display surface a two-dimensionally periodic pattern of luminescent deposits having a smallest deposit-to-adjacent-deposit pitch "P-D" which is different in predetermined different parts of the display, said display having on the front of said CRT a touch responsive membrane which has impressed in an outer surface glare reduction means comprising a two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, the pitch "P-E" varying across the display to preserve a predetermined geometrical relationship between said patterns in at least said predetermined different parts of the display, said pattern of light-scattering elements being azimuthally rotated relative to said deposit pattern to minimize moire' interaction between said patterns, each element comprising a gentle undulation having an amplitude great enough to scatter reflected light and suppress specular reflections, but small enough to prevent unacceptable degradation of images formed by said luminescent elements when stimulated, the element pitch "P-E" being in the order of about 3 mils.

19. For use with a high resolution shadow mask color CRT display comprising a glass faceplate having on an inner display surface a periodic pattern of luminescent deposits having a smallest deposit-to-adjacent-deposit pitch "P-D", a sparkle-free, anti-glare touch responsive membrane having on an outer surface glare reduction means comprising a periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, the element pitch "P-E" being in the order of about 3 mils, and the maximum tilt angle of elements being in the order of about 1.5 degrees.

20. For use with a shadow mask color CRT display comprising a glass faceplate having on an inner display surface a periodic pattern of luminescent deposits with deposits oriented along two or more deposit axes, a sparkle-free, anti-glare touch responsive membrane which has on an outer surface a periodic pattern of light-scattering elements oriented along two or more element axes, said pattern of light-scattering elements being azimuthally rotated relative to said deposit pattern when said membrane is overlaid on said display such that said element axes are intermediate said deposit axes to minimize moire' interaction between said patterns, the element pitch of said light-scattering elements being approximately equal to the square root of the product of the distance between said inner and outer surfaces and the wavelength of the predominate light within the faceplate material.

21. The membrane defined by claim 20 wherein the individual elements in said pattern of light-scattering elements are substantially sinusoidal.

22. For use with a high resolution shadow mask color CRT display comprising a glass faceplate having on inner display surface a periodic pattern of luminescent deposits whose smallest deposit-to-adjacent-deposit pitch "P-D" is different in predetermined different parts of the display, a sparkle-free, anti-glare touch responsive membrane having on an outer surface glare reduction means comprising a regular pattern of light-scattering elements whose smallest element-to-adjacent-element pitch "P-E" varies to preserve a predetermined geometrical relationship between said patterns in at least said predetermined different parts of the display when said membrane is overlaid on said CRT display.

23. For use with a high resolution shadow mask color CRT display comprising a glass faceplate having on an inner display surface a two-dimensionally periodic pattern of luminescent deposits having a smallest deposit-to-adjacent-deposit pitch "P-D", a sparkle-free, anti-glare touch responsive membrane having on an outer surface glare reduction means comprising a pattern of two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, said pattern of light-scattering elements being azimuthally rotated relative to said deposit pattern when said membrane is overlaid on said CRT display to minimize moire' interaction between said patterns, the element pitch "P-E" being in the order of about 3 mils, the maximum tilt angle of elements being in the order of about 1.5 degrees, and said pitch "P-E" being approximately equal to the square root of the product of the distance between said inner and outer surfaces and the wavelength of the predominant light within the faceplate material.

24. For use with a high resolution shadow mask color CRT display comprising a glass faceplate having on an inner display surface a two-dimensionally periodic pattern of luminescent deposits having a smallest deposit-to-adjacent-deposit pitch "P-D", a sparkle-free, anti-glare touch responsive membrane having on an outer surface glare reduction means comprising a two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, said pattern of light-scattering elements being azimuthally rotated relative to said deposit pattern when said membrane is overlaid on said CRT display to minimize moire' interaction between said patterns, each element comprising a gentle undulation having an amplitude great enough to scatter reflected light and suppress specular reflections, but small enough to prevent unacceptable degradation of images formed by said luminescent elements when stimulated, the maximum tilt angle of elements being in the order of about 1.5 degrees.

25. For use with a high resolution shadow mask color CRT display comprising a glass faceplate having on an inner display surface a periodic pattern of luminescent deposits whose smallest deposit-to-adjacent-deposit pitch "P-D" is different in different parts of the display, a sparkle-free, anti-glare touch responsive membrane having on an outer surface glare reduction means comprising a periodic pattern of light-scattering elements whose smallest element-to-adjacent-element pitch "P-E" is significantly greater than the longest wavelength of visible light to minimize diffraction effects, the pitch "P-E" varying across the display to preserve a predetermined geometrical relationship between said patterns in at least said predetermined different parts of the display when said membrane is overlaid on said CRT display.

26. For use with a high resolution shadow mask color CRT display comprising a glass faceplate having on an inner display surface a two-dimensionally periodic pattern of luminescent deposits having a smallest deposit-to-adjacent-deposit pitch "P-D" which is different in predetermined different parts of the display, a sparkle-free, anti-glare touch responsive membrane having on an outer surface glare reduction means comprising a two-dimensionally periodic pattern of light-scattering elements whose smallest element-to-adjacent-element pitch "P-E" is significantly less than the pitch "P-D" to avoid moire' effects, but significantly greater than the longest wavelength of visible light to minimize diffraction effects, the pitch "P-E" varying across the display to preserve a predetermined geometrical relationship between said patterns in at least said predetermined different parts of the display when said membrane is overlaid on said CRT display, said pattern of light-scattering elements being azimuthally rotated relative to said deposit pattern when said membrane is overlaid on said CRT display to minimize moire' interaction between said patterns, each element comprising a gentle undulation having an amplitude great enough to scatter reflected light and suppress specular reflections, but small enough to prevent unacceptable degradation of images formed by said luminescent elements when stimulated.

27. A sparkle-free, anti-glare high resolution color display device having a faceplate whose inner surface carries a periodic pattern of luminous deposits whose pitch is so fine that the pattern structure is invisible at normal viewing distances, said high resolution display when treated with conventional anti-glare treatments comprising random light scatters being subject to an objectional random sparkle effect associated in high resolution displays with random moire' interactive effects between the light scatters and the luminous deposits, said display including anti-glare means for preventing said sparkle effect without deleterious smearing or spreading of image light due to diffractive or refractive effects, comprising a periodic array of transparent undulating elements on said faceplate, said undulating elements having a maximum slope causing the elements to be weakly refractive and weakly diffractive in order not to significantly spread image light emitted by said luminous deposits, said array of undulating elements having a pitch many tens of times greater than the wavelength of image light so as not to create deleterious diffractive spreading of image light, but said pitch being not quite so great as the pitch of said luminous deposits in order that moire' interaction with said luminous deposits is avoided, whereby said random sparkle is prevented without significant smearing or spreading of image light due to either refractive or diffractive effects.

28. The display device defined by claim 27 wherein the pitch of the undulating elements is between about 3 mils.

29. A display device having a faceplate whose inner surface carries an array of luminous elements, the spacing between such elements being small enough to produce a high resolution image, said display device including glare reduction means on said faceplate comprising a sinusoidally undulating outside surface, said undulating surface diffracting the light from said luminous elements into a plurality of diffraction orders whose intensity distribution is governed by the maximum angle of the undulations and whose separation is inversely proportional to said pitch, the pitch and the maximum slope of the undulating surface being so related to each other that the angle between adjacent diffraction orders approaches but does not exceed the angle of refraction produced by the maximum slope, whereby any impairment of image resolution by the glare reduction means is minimized.

* * * * *